US006767317B2

(12) United States Patent
Simhaee

(10) Patent No.: US 6,767,317 B2
(45) Date of Patent: Jul. 27, 2004

(54) GUSSETTED PLASTIC BAG

(76) Inventor: Ebrahim Simhaee, 112 N. Maple Dr., Beverly Hills, CA (US) 90210

( * ) Notice: Subject to any disclaimer, the term of this patent is extended or adjusted under 35 U.S.C. 154(b) by 21 days.

(21) Appl. No.: 10/007,985

(22) Filed: Nov. 2, 2001

(65) Prior Publication Data

US 2002/0191868 A1 Dec. 19, 2002

Related U.S. Application Data

(60) Division of application No. 09/707,758, filed on Nov. 7, 2000, now Pat. No. 6,461,041, which is a continuation-in-part of application No. 09/504,427, filed on Feb. 15, 2000, now abandoned.

(51) Int. Cl.[7] ..... B31B 1/90

(52) U.S. Cl. ..... 493/210; 493/186; 383/119; 383/121; 383/903

(58) Field of Search ..... 383/119, 121, 383/903; 493/209, 206, 210, 374, 382, 178, 186

(56) References Cited

U.S. PATENT DOCUMENTS

| | | | | | |
|---|---|---|---|---|---|
| 3,468,470 | A | * | 9/1969 | Sengewald | 383/10 |
| 3,829,007 | A | * | 8/1974 | Ellison | 229/55 |
| 4,464,157 | A | * | 8/1984 | Benoit et al. | 493/211 |
| 4,812,055 | A | * | 3/1989 | Prader et al. | 383/119 |
| 4,874,256 | A | * | 10/1989 | Baines | 383/21 |
| 4,883,450 | A | * | 11/1989 | Benoit | 493/196 |
| 4,895,556 | A | * | 1/1990 | Jensen | 493/209 |
| 5,030,190 | A | * | 7/1991 | Woods et al. | 493/189 |
| 5,944,189 | A | * | 8/1999 | Vollenweider et al. | 206/484 |
| 6,071,010 | A | * | 6/2000 | Chan | 383/2 |

* cited by examiner

*Primary Examiner*—Rinaldi I. Rada
*Assistant Examiner*—Gloria R Weeks
(74) *Attorney, Agent, or Firm*—Darby & Darby

(57) ABSTRACT

A plastic T-shirt bag comprises an extruded plastic tubular form having side gussets and a seal line at the bottom of the bag. The junctions of the inner folds of the gussets and the seal line are the weakest areas of the bottom of the bag. A reinforcement tape extends across both weakened areas and takes up the forces applied to them when the bag is loaded.

7 Claims, 7 Drawing Sheets

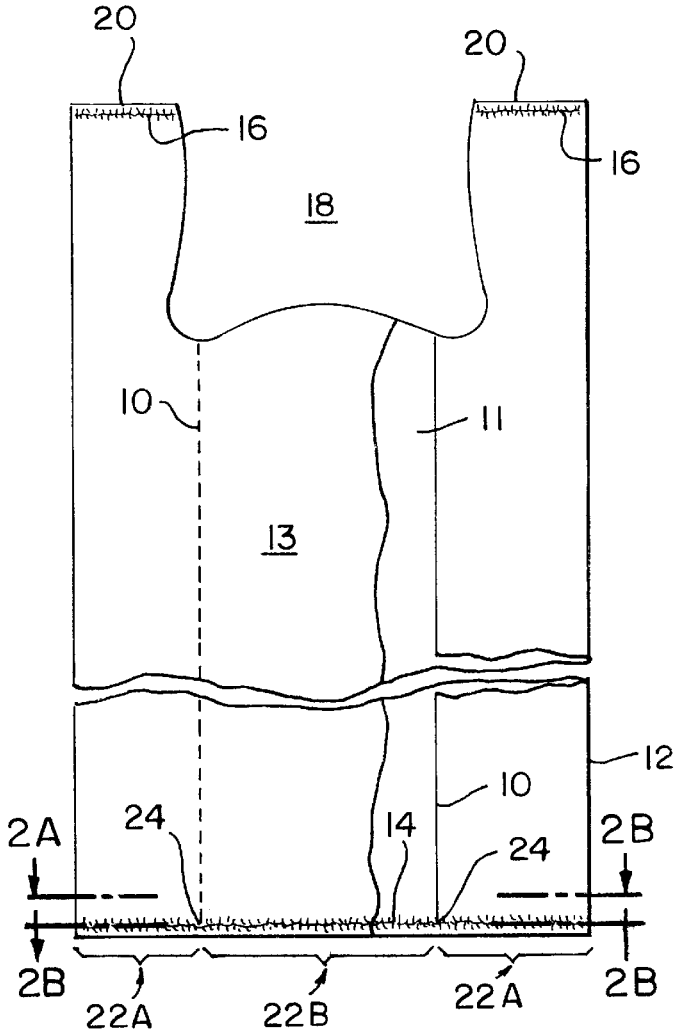
FIG. 1
PRIOR ART
FIG. 2A
PRIOR ART
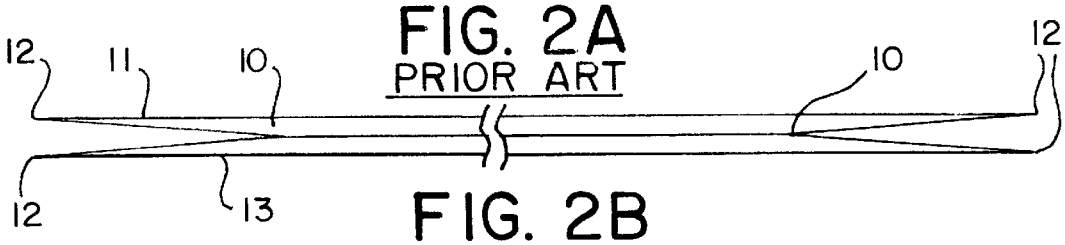
FIG. 2B
PRIOR ART
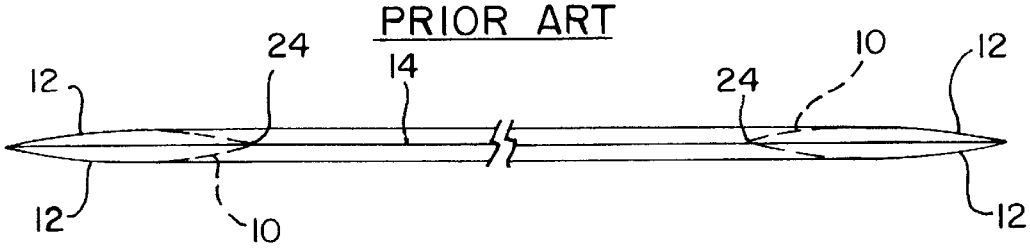

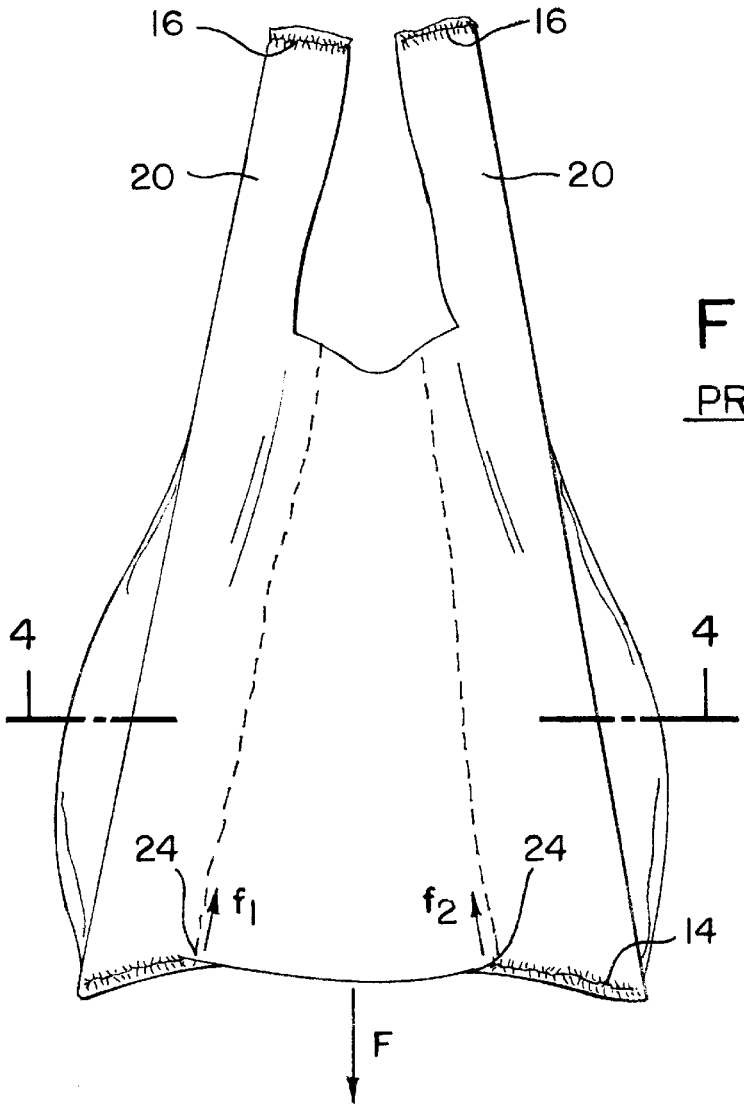
FIG. 3
PRIOR ART
FIG. 4
PRIOR ART
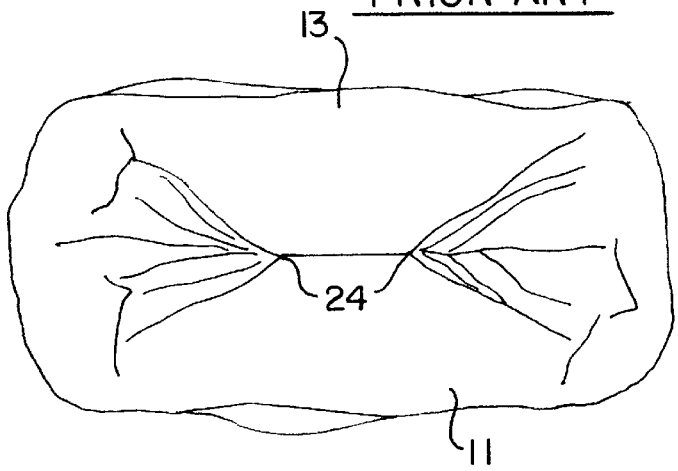

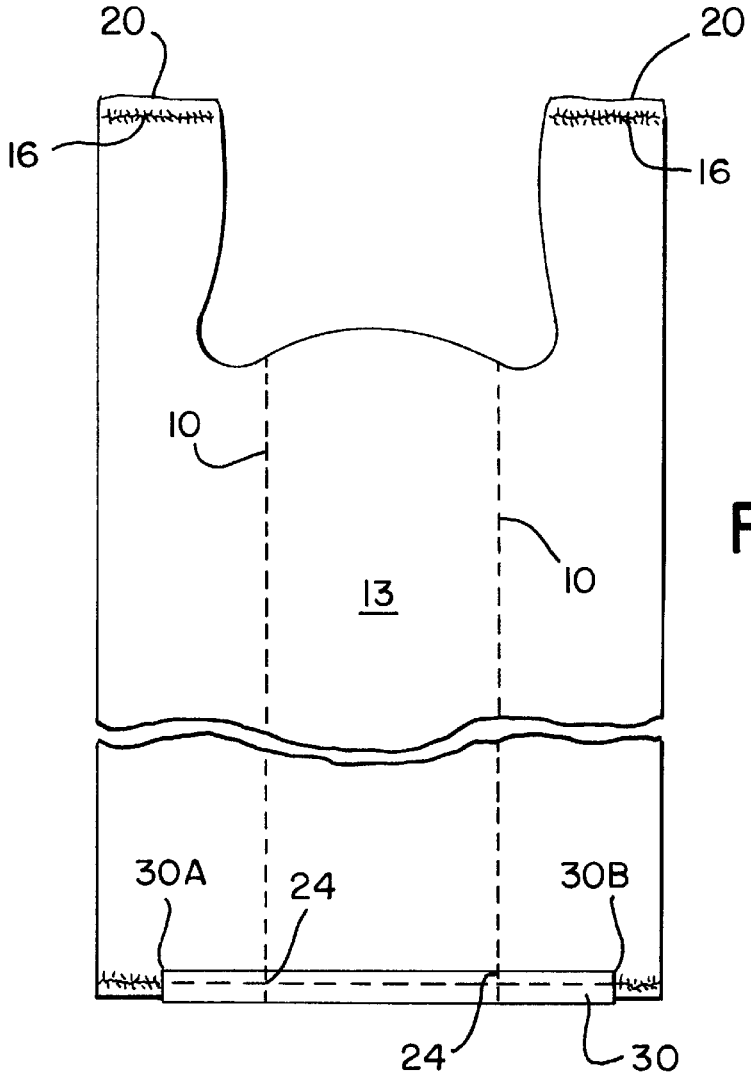
FIG. 5
FIG. 6
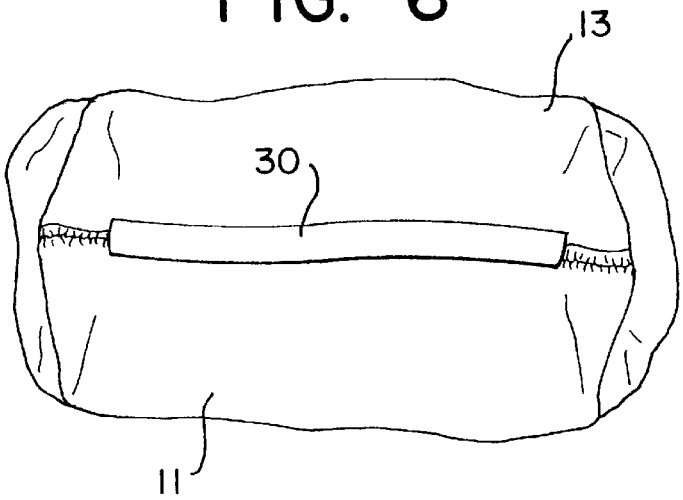

GUSSETTED PLASTIC BAG

This is a division, of application Ser. No. 09/707,758, filed Nov. 7, 2000, now U.S. Pat. No 6,461,041, which is a continuation-in-part of U.S. application Ser. No. 09/504,427 filed Feb. 15, 2000 now abandoned. Each of these prior applications is hereby incorporated herein by reference, in its entirety.

This invention relates to plastic bags and, more particularly, to gussetted bags, especially bags commonly referred to as T-shirt bags.

BACKGROUND OF THE INVENTION

A bag commonly in use throughout the United States and elsewhere is known as a T-shirt bag. T-shirt bags are customarily made from tubular plastic film which is gussetted, sealed and cut to form a bag with handles on the sides of the bag.

The handles for a T-shirt bag are formed from the gussetted side regions. As a result, when the bag is loaded and lifted by the handles, relatively large forces are applied in opposite direction to the areas at the junctions of the bottom seal and the gusset folds. The bag, therefore, is most likely to tear at those junctions when it is loaded and lifted by the handles.

If an overloaded bag does not rupture at the gusset-bottom seal junctions, it is likely to tear at the handles. The handles can be strengthened if they are made wider, but the width of the handles is limited to the width of the gussets, and the wider the gussets the weaker the junctions of the gussets and the bottom seal.

To overcome these problems, the thickness of the plastic film can be increased or the quality of the plastic can be improved but the junctions, while strengthened proportionately, will remain the weakest areas in the bag. These solutions, moreover, result in added expense by virtue of the increase in quality or quantity of the raw material.

Furthermore, when the tubular film is gussetted, the thickness of the gussetted regions at the sides of the bag is twice that of the ungussetted portion in the center. The sealing means which forms the seal at the bottom of the bag must provide sufficient heat to weld together all four layers in the gussetted regions. This is more heat than is required for the ungussetted central region of the bag. The excessive heat applied to the ungussetted portion creates a weakness, particularly in the area of the junctions of the gusset folds and the bottom seal.

One possible approach to this problem is to increase the sealing time by decreasing the speed of the sealing process. This change, however, does not totally solve the problem and, moreover, because of the decrease in production speed, results in increased costs for the final product.

The principal object of this invention is to provide a gussetted plastic bag which is stronger than prior art bags of comparable construction and which is essentially no more expensive to make.

Another object of the invention is to provide a gussetted plastic bag in which the junctions of the gusset folds and seal line are not the weakest areas of the bag.

A more specific object of the invention is to provide an economic way of strengthening a conventional T-shirt bag without significantly increasing the cost of manufacture.

A still further object of the invention is to provide a T-shirt bag having wider handles for a given thickness of plastic film.

SUMMARY OF THE INVENTION

In accordance with the invention, at least one plastic tape is bonded to the bottom of a gussetted plastic bag over a region which includes, or is close to, the junctions between the gusset folds and the bottom seal. Preferably, two tapes are applied to opposite sides of the bag or a single plastic tape is folded across the seal. The effect is to transfer the forces normally applied to the seal/gusset junctions to the tape so that the bag will no longer tear first in the areas of the two junctions.

IN THE DRAWINGS

FIG. 1 is a front plan view showing a prior art T-shirt bag for purposes of explanation;

FIG. 2A is a sectional view along the line 2A—2A of FIG. 1;

FIG. 2B is a sectional view along the line 2B—2B of FIG. 1;

FIG. 3 is a front plan view of a prior art T-shirt bag fully loaded;

FIG. 4 is a bottom view of the fully loaded T-shirt bag shown in FIG. 3;

FIG. 5 is a front plan view of a T-shirt bag in accordance with the invention; and FIG. 6 is a bottom view of the T-shirt bag shown in FIG. 5 fully loaded.

DETAILED DESCRIPTION

Figure 7A:
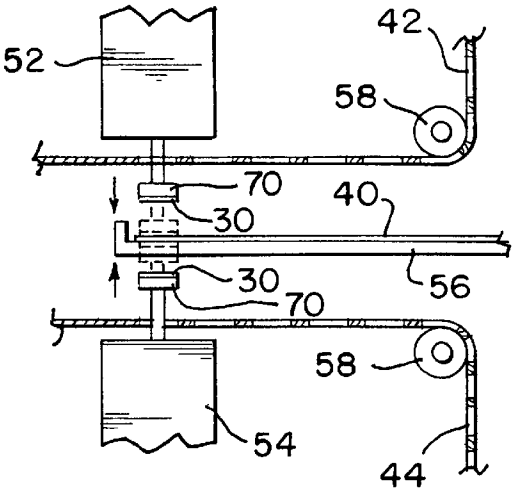
FIG. 7A is an enlarged view of the tape application stations shown in FIG. 7.

A prior art T-shirt bag is shown in FIG. 1 for purposes of explanation. By way of example, the bag may be manufactured from an extruded tubular form made of polyethylene. The tube is then partially gussetted, forming an inner fold 10 and two outer folds 12 on each side. The flattened, gussetted web, which includes outer panels 11 and 13, is next passed to a welding station to form a bottom seal 14 and an upper seal 16. The sealed web is then passed through a die cutting station in which the individual bags are cut from the web. The bags are then stacked (for example, in stacks of fifty bags) and each stack of bags cut to form cut-out regions 18 in the bags. As a result of the shape of the cut-out region 18, two handles 20 are formed in the gussetted side portions of the bag.

The gussetted bag contains two outer regions 22A, each of which contains four plies of film, and a central region 22B which contains only two plies. During the heat sealing step, sufficient heat must be applied to the bottom of the bag to weld all four layers in the regions 22A together. Practically, it is not possible to apply less heat to the region 22B where there are only two plies; as a result, application of the heat required to form the seal 14 in regions 22A produces excessive heat in the region 22B. Because of this excessive heat, the seal 14 is weakened in the central region 22B.

The seal 14 is formed by a sealing bar which is moved into contact with the gussetted web as it is moved through a sealing station. The formation of the seal is dependent on the temperature of the bar, the dwell time of the bar on the web, and the pressure applied by the bar. The thicker the plastic layers, the greater the heat and/or pressure required to form the seal line. Greater heat can be provided by increasing the temperature of the seal bar or the dwell time. Ordinarily, an increase in pressure is not a large factor. It is preferable to increase temperature substantially in order to avoid increasing dwell time which, of course, slows the manufacturing process. By way of example, if the thickness of the web is 15 microns, a seal bar heated to 350° F. will optimally require a dwell time of 0.8 seconds at a pressure of 45 psi. If the thickness of the web is increased to 30 microns, the same dwell time can be obtained if the temperature of the seal bar is increased to 450° F. and the pressure increased minimally to 46 psi.

FIG. 3 illustrates the prior art T-shirt bag after it has been loaded and lifted by the handles 20. The contents of the bag will exert a force due to gravity indicated by the arrow F. Because the handles are attached to the bottom of the bag at the junctions 24, the weight of the contents in the bag creates equal forces $f_1$, and $f_2$ which are applied in opposite directions primarily to the junctions. Consequently, these junctions are the areas of the bag which are most likely to fail (i.e. tear) if the weight in the bag is excessive.

As the gusset becomes deeper, the tendency of the junctions to fail increases. The area of the junctions is weakest when the bag is fully gussetted, i.e. when the junction of the inner folds 10 and the seal line 14 meet at the center of the seal line. On the other hand, deeper gussets are preferred because they allow wider handles 20. Wide handles are preferred because they can bear more weight; moreover, from the consumer's view point they are more comfortable.

As indicated above, the strength of a T-shirt bag can be increased by increasing the thickness of the film or the quality of the plastic, both of which increase the cost of the bag. This invention achieves superior results by providing a reinforcement tape which takes up the forces tending to separate the junctions 24 when the bag is loaded. In accordance with the invention, as shown in FIGS. 5 and 6, a tape 30 is bonded to the bottom of the bag across seal 14 and serves to absorb the forces applied to the junctions 24. The tape 30 is shown extending from point 30A to 30B. The length of the tape is not critical but the tape should be longer than the distance between the junctions 24 and, in general, the longer the tape 30, the greater the reinforcement. Surprisingly, the tape enhances the strength of the bag more than a comparable increase in film thickness. In other words, a 15 micron bag having two 15 micron tapes is substantially less likely to fail at junctions 24 than a 30 micron bag which provides the same thickness at the junctions.

It is contemplated that a single tape 30 may be folded over the bottom of the bag, but separate tapes may be applied to each side of the bag and the same result will be achieved in terms of reinforcing junctions 24. Some benefit is obtained if only the junction areas are taped by separate tapes, for example ½ inch square. A polypropylene tape having a pressure sensitive adhesive may be used, but a wide variety of materials are useful including the material from which the bag is made. In place of a pressure sensitive adhesive, a thermally activated adhesive coating may be employed or the tape itself may be made of a material which can be welded or sealed to the bag.

The dimensions of the tape also are not critical. The tape may extend about two mm above and below the seal. If a single tape is folded over the bottom, the tape should be wide enough to extend two mm above the seal on both sides of the bag.

Satisfactory results can be obtained by using only a single tape applied to one of the panels 11 or 13. Ordinarily, if the inner folds 10 of the unreinforced bag are pulled apart from the outer panels 11 and 13 (which are bonded together at junctions 24 on seal line 14) the outer panels will start to tear at the points 24 at the same time. It has been observed that if a reinforcement tape is applied to only one of the panels 11 or 13, the tendency of both panels to tear is substantially reduced. Again, the dimensions of the tape are not critical and good results have been obtained with a tape which extends over both of the junctions 24 and which ranges in width from ¼ inch to ½ inch.

There are a number of different processes and machines for manufacturing T-shirt bags. In the process referred to above where the individual bags are cut from the web and stacked, a conventional taping machine could be used to bond one or two tapes to the bottom seal of each bag just prior to stacking. As indicated above, instead of applying separate tapes, a single folded tape may also be applied.

In the illustrated embodiment, the seals 14 and 16 are formed about three mm away from the edge of the bag. In some processes, the bags are cut and sealed simultaneously by a hot knife in which case the seals are formed at the edges of the bag. The invention is equally applicable to this and other constructions as well. In fact, the invention would have utility in any case where a gussetted plastic bag is sealed after gussetting even if the bag does not include handles.

In some cases, T-shirt bags are provided in rolls with the individual bags being separated by a perforated separation line. The bags are dispensed one by one by tearing successive separation lines. In this case, the reinforcement tape in accordance with the invention would be applied just above (in front of) the perforations, preferably with a separate tape on each side of the bag.

FIGS. 7–10 illustrate in schematic form a machine for applying two tapes to opposite sides of a bag during the manufacturing process.

Figure 9:
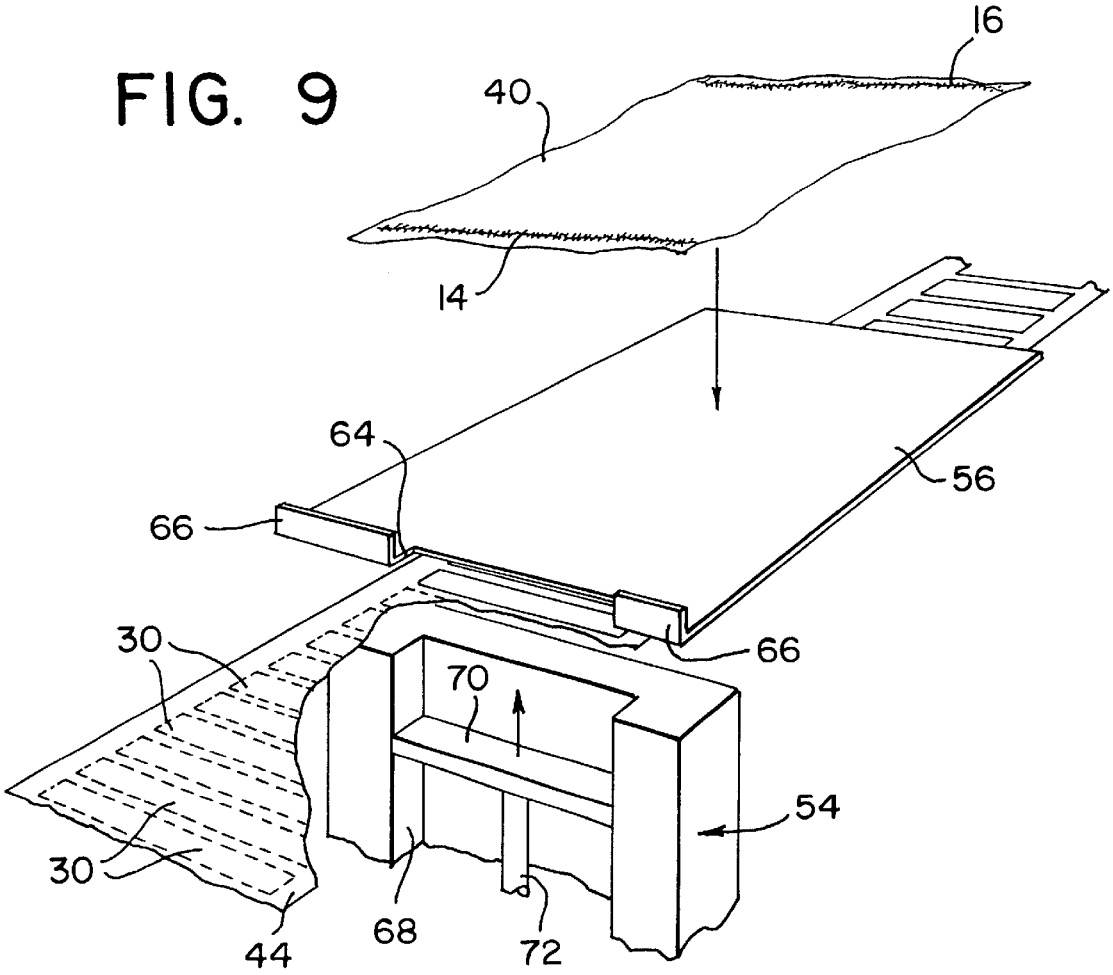
FIG. 9 is an exploded perspective view showing how the underneath tape is applied, the mechanism for applying the upper tape being essentially the same.

In the typical T-shirt manufacturing process, the gussetted tube is sealed at its top and bottom (seals 16 and 14) and cut to form a blank 40 (see FIG. 9). A batch of blanks is then stacked, for example, fifty to a stack, and die cut to form the handles 20. It is contemplated that the reinforcement tape 30 will be applied to a bag prior to the stacking and die cutting operation, although the invention is equally applicable to processes in which the tape is applied at other times during the manufacturing cycle.

Figure 7:
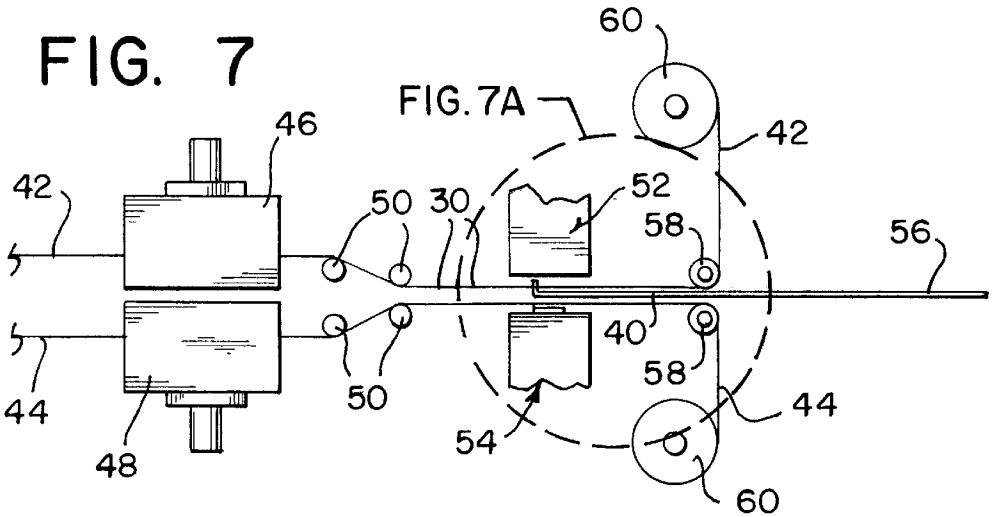
FIG. 7 is a side plan view of a machine for applying reinforcement tapes to both sides of a bag.
Figure 8:
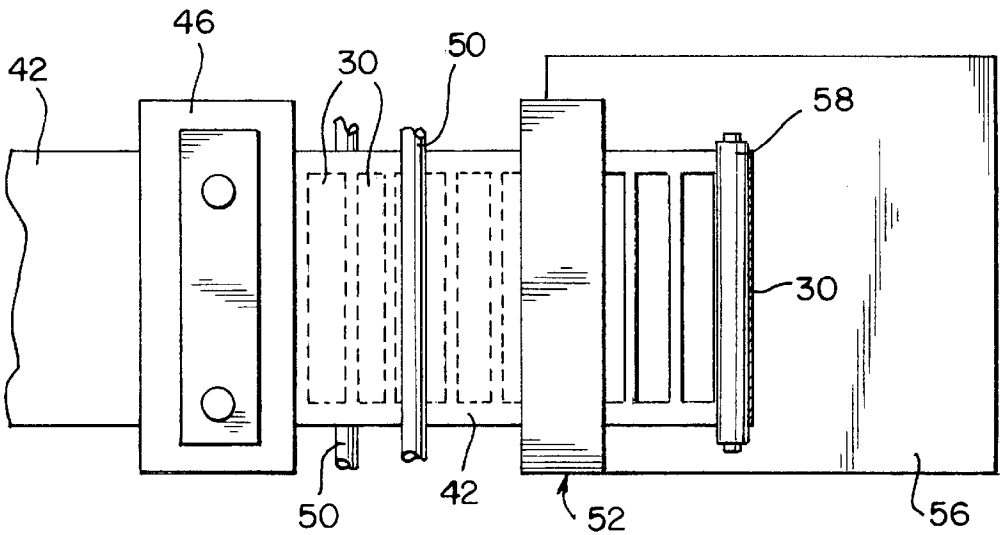
FIG. 8 is a top view of the machine shown in FIG. 7.

As shown in FIGS. 7 and 8, upper and lower plastic film strips 42 and 44, respectively, are passed through two tape forming machines 46 and 48. Each tape forming machine, 46, 48, forms a multiplicity of reinforcing tapes 30 of the desired dimensions within the strips 42 and 44. The machines 46 and 48 may be similar to label manufacturing machines and form the successive tapes 30 by scoring so that they are retained by the strips 42 and 44 yet can be easily removed in a tape application station. This is reflected by the dashed lines which define the periphery of the individual tapes 30 within strip 42 in FIG. 8.

The scored strips 42, 44 are moved across a series of rollers 50 through upper and lower tape application stations 52 and 54, respectively. As explained below, the tapes 30 are applied to both sides of a T-shirt blank 40 which is supported within a tray 56. The strips 42 ane 44 with the reinforcing tapes 30 now removed are then passed around rollers 58 and wound into rolls 60 and 62.

Figure 10:
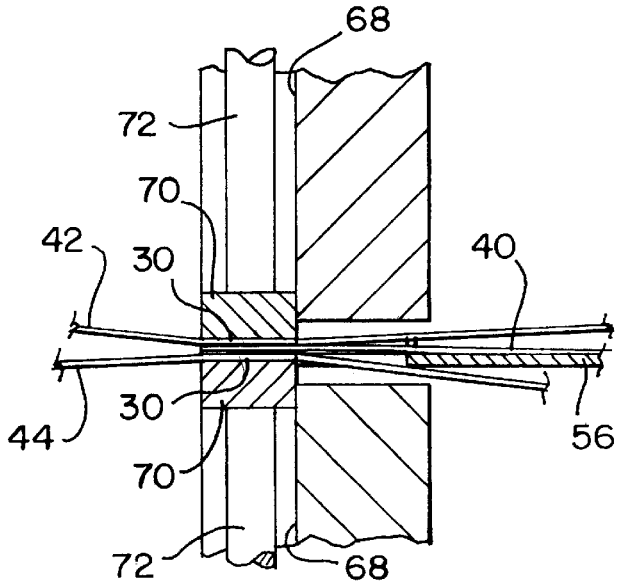
FIG. 10 is a side sectional view of the devices which bond the two tapes to the opposite sides of the bag.

The actual application of the tape is shown in FIGS. 9 and 10. FIG. 9 illustrates only the bottom tape application station 54, the upper station being its mirror image.

The tray 56 includes a cut out tape application region 64 and registration lips 66 which align the T-shirt blank 40 so that the lower seal 14 sits within the cut out region 64 and is accessible to the tapes as strips 42, 44 passes through the stations 52, 54. Each tape application station includes a vertical track 68 in which a pressure head 70 moves vertically. The area of the pressure head 70 corresponds to the area of an individual tape 30 and is connected to the end of a reciprocating rod 72. Movement of the strips 42 and 44 is synchronized with the movement of the blank 40 and the pressure head 70, for example, in response to the optical sensing of a properly registered blank 40 within the tray 56. When the blank is properly positioned, the pressure heads 70 are moved vertically in both of the stations 52 and 54 which punches the individual tapes 30 from the strips 42 and 44 and seals them under pressure across the bottom seal 14 as described above. Preferably, the heads 70 are electrostatically charged so that after they remove the scored tape, the tapes 30 tend to cling to the heads until they have been applied to the bag. The tapes 30 may be sealed to the bag by a pressure sensitive adhesive or by a thermally activated adhesive. If the latter, the pressure heads 70 in the stations 52 and 54 would be heated.

After the tapes 30 have been applied to the opposite sides of blank 40, the blank is removed and stacked for subsequent cutting of the handles. The apparatus used to position the blank 40 within tray 56 and remove the blank after the tapes have been applied may be conventional and, therefore, is not described in detail.

Figure 11:
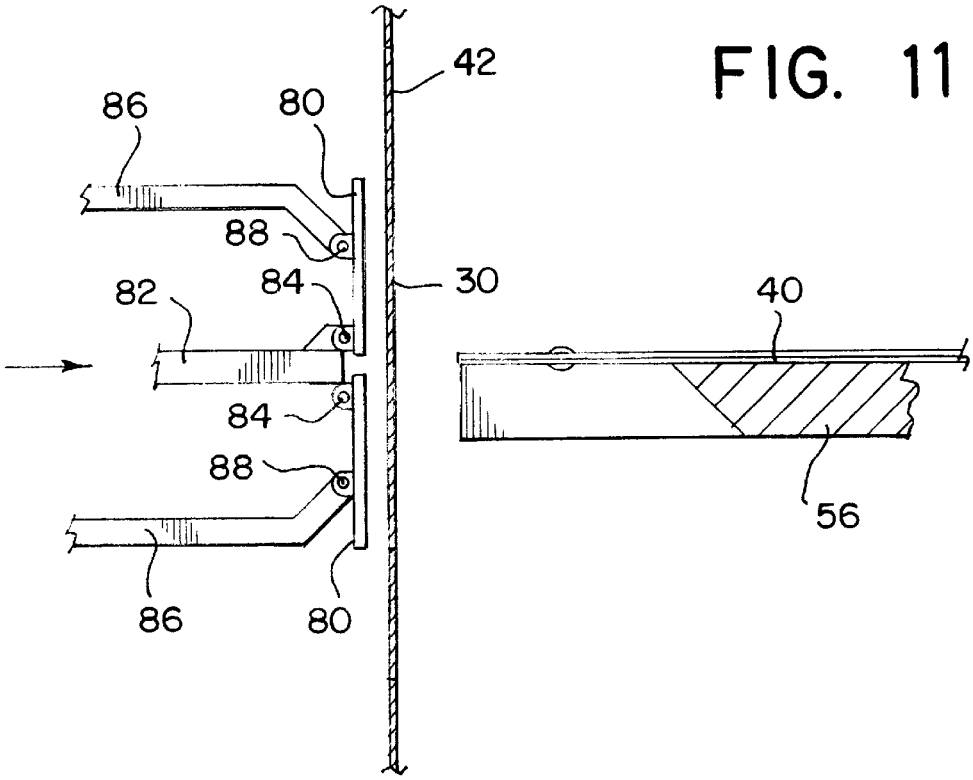
FIG. 11 is a side view, partially in section, showing a mechanism for folding a single tape over the bottom of a bag.
Figure 12:
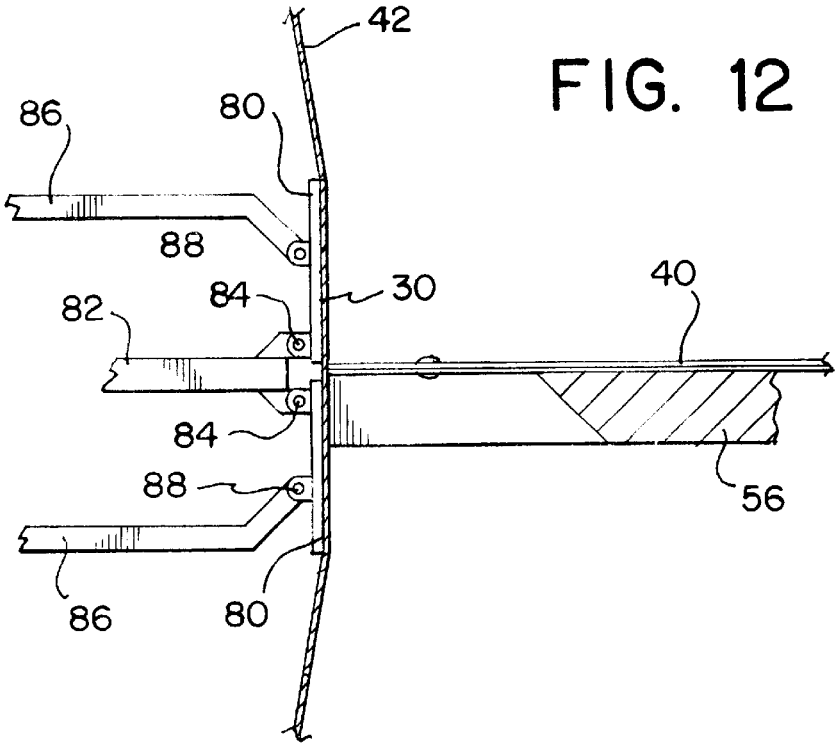
FIG. 12 is a side sectional view of the device shown in FIG. 11, just prior to folding.
Figure 13:
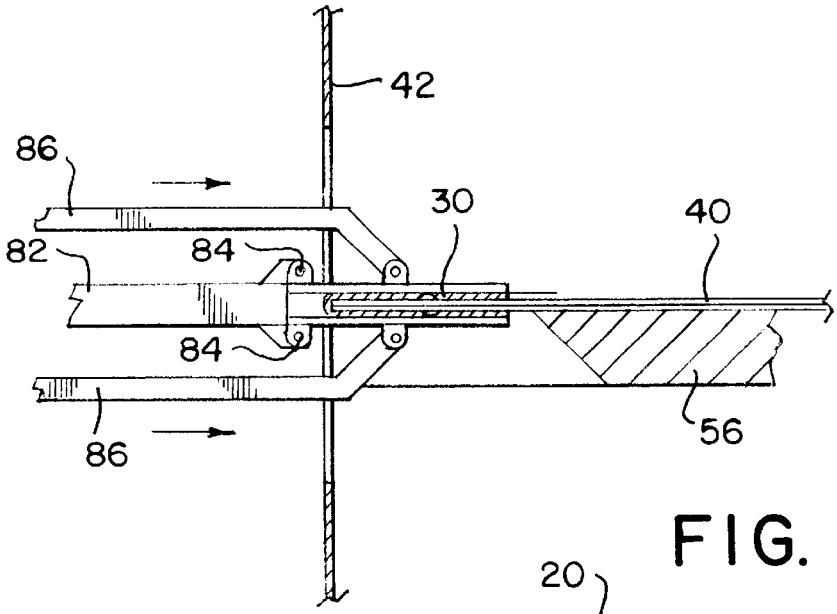
FIG. 13 shows the mechanism of FIGS. 11 and 12 after the tape has been folded over the bottom edge of the bag.

FIGS. 11, 12, and 13 show a device which can fold a single tape around the bottom of a blank 40. In this case, the tapes 30 are partially die cut from a single strip 42 which moves vertically. The device includes two heads 80 which are connected at their inner ends to a central support rod 82 by pivotable connectors 84. The heads 80 are also connected to a pair of actuator bars 86 by a similar pivotable connection 88. When a T-shirt blank 40 is properly positioned within the support tray 56, the mechanism moves from the FIG. 11 position to the FIG. 12 position thereby separating a tape 30 from the strip in which it was die cut. The central support rod 82 stops but the outer actuator bars 86 continue to move toward the blank 40 causing the heads 80 to pivot about the connectors 84 as shown in FIG. 13. This action folds the tape 30 over the bottom of the T-shirt blank 40 and, at the end of the stroke, applies pressure causing the tape to adhere to the bag. The mechanism then returns to the initial position shown in FIG. 11 where it is in position to apply the next tape 30 to the next T-shirt blank 40 after it has been properly positioned within the tray 56.

Figure 14:
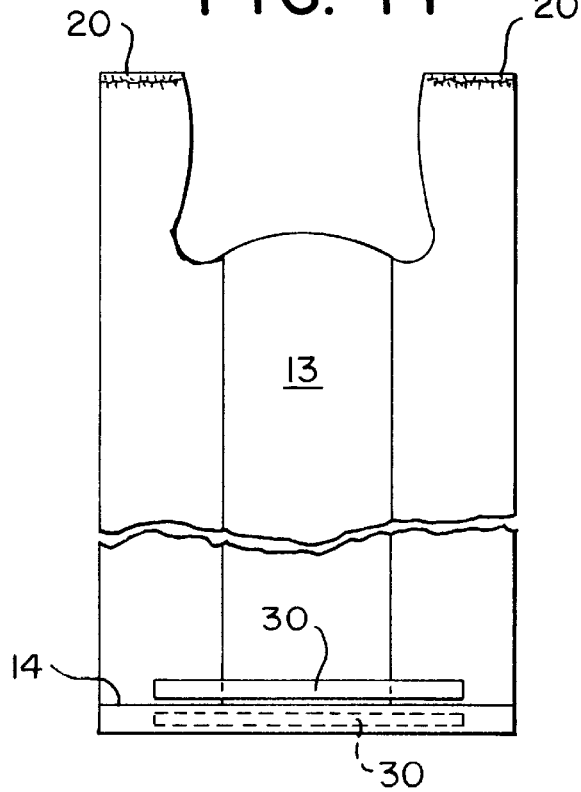
FIG. 14 shows another embodiment of the invention.

Surprisingly, it has also been found that a tape 30 applied to one or both panels 11 and 13 need not overlap the seal line 14 to provide considerable reinforcement. Thus, as shown in FIG. 14, a tape 30 positioned slightly above the seal line (as shown in solid lines) or slightly below the seal line (as shown in dotted lines) will provide substantial reinforcement. For example, the tape may be positioned about 1 mm above or below the seal line.

Figure 15:
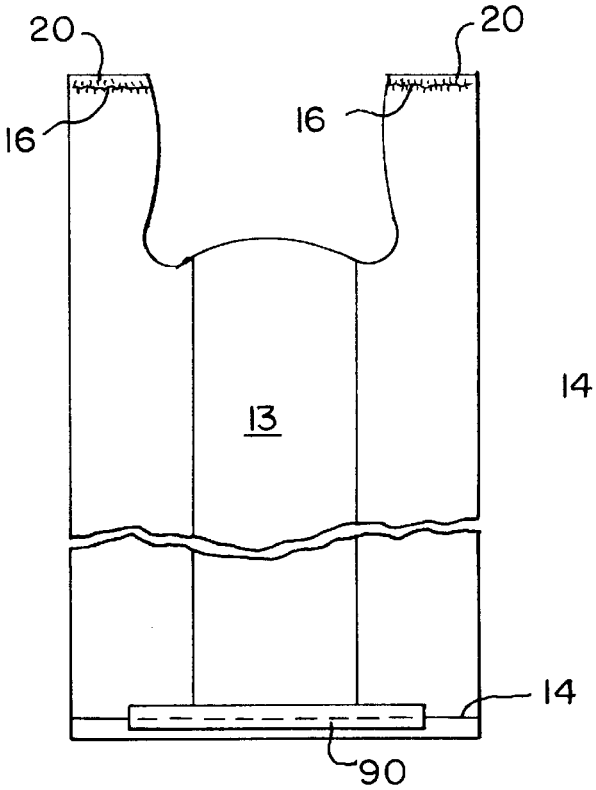
FIG. 15 shows an embodiment of the invention in which a non-adhesive tape is employed.

A further embodiment of the invention is shown in FIG. 15. In this embodiment, as shown in dotted lines, a nonadhesive plastic strip 90 is thermally bonded to the bag along the seal line 14 when the seal line 14 is formed. The plastic strip 90 can be the same material as the material from which the bag is made. Again, the length of the strip should be greater than the distance between the junctions 24. The width need only be sufficient to encompass the width of the seal line. In the preferred embodiment, the thickness of the strip is about twice that of the thickness of the plastic film from which the T-shirt bag is manufactured; however, if the thickness is about half the thickness of the panels 11 and 13 the result is satisfactory. It has also been found that the junctions 24 of a T-shirt bag reinforced by a strip 90 which is half the thickness of the bag (e.g. 15 microns) are stronger than the junctions of a T-shirt bag made of the same plastic film which is twice as thick (i.e. 30 microns). Further, satisfactory results are obtained if the strip is placed on the inside of the bags, e.g. between one or both panels 11 and 13 and the gusset folds.

The effect of the separate tape 30 or strip 90 is greater than the effect achieved by increasing the thickness of the bag at the seal line 14 which increases the plastic material available for melting and sealing, thereby increasing the strength of the seal. The presence of the added layer of material provides greater strength than a comparable increase in film thickness.

Furthermore, referring to FIG. 1, in a standard T-shirt bag there are four layers of film in the regions 22A and two layers of film in region 22B. The thickness ratio in these two regions is thus 4 to 2. When strip 90 is added with a thickness twice that of the individual plies, the thickness of the gussetted areas 22A becomes equal to six layers while the thickness of area 22B becomes equal to the thickness of four layers. Hence, the thickness ratio is 6 to 4. Stated in other words, with the reinforcement strip in place, the gussetted areas 22A are 1.5 times as thick as the ungussetted area 22B, whereas without the reinforcement strip, the gussetted portion is twice as thick as the ungussetted portion 22B. By improving (i.e. reducing) this thickness ratio, the strength of the junctions 24 is enhanced.

What is claimed is:

1. A method of manufacturing a plastic T-shirt bag, comprising longitudinally gussetting a tubular plastic web to form two longitudinal inner gusset folds, forming a seal line across the gussetted tubular web, and reinforcing the junctions of the seal line and inner gusset folds by applying at least one reinforcing tape over the seal line, the tape extending into the gussetted regions of the bag.

2. A method of manufacturing a plastic T-shirt bag according to claim 1, wherein reinforcing tape is applied to each side of the bag.

3. A method of manufacturing a plastic T-shirt bag according to claim 1, wherein a single tape is folded over the sealed end of the bag.

4. A method of manufacturing a plastic T-shirt bag according to claim 1, wherein the gussetted tubular web is sealed at both ends prior to application of the tape.

5. A method of manufacturing a plastic T-shirt bag according to claim 1, wherein the reinforcing web is thermally bonded to the bag along the seal line when the seal line is formed.

6. A method of manufacturing a plastic T-shirt bag according to claim 1, wherein after the reinforcing tape has been applied to one end of the bag, handles are cut into the opposite end of the bag to form a T-shirt bag.

7. A method of manufacturing plastic T-shirt bags according to claim 1, wherein the tubular plastic web is partially gussetted so that there is a gap in which there is no gusset fold between the two inner gusset folds.

* * * * *